US005129543A

United States Patent [19]

White

[11] Patent Number: 5,129,543

[45] Date of Patent: Jul. 14, 1992

[54] RECYCLING CONTAINER

[76] Inventor: David E. White, P.O. Box 789, Plattekill, N.Y. 12568

[21] Appl. No.: 694,248

[22] Filed: May 1, 1991

[51] Int. Cl.[5] ..... B65D 91/00

[52] U.S. Cl. ..... 220/503; 220/909

[58] Field of Search ..... 220/503, 908, 909, 23.83, 220/23.86, 339

[56] References Cited

U.S. PATENT DOCUMENTS

| | | | |
|---|---|---|---|
| 1,021,872 | 4/1912 | Kingsbury | 220/909 X |
| 2,895,782 | 7/1959 | Fragale | 220/909 X |
| 4,471,881 | 9/1984 | Foster | 220/339 |
| 4,834,253 | 5/1989 | Crine | 220/909 X |
| 4,834,262 | 5/1989 | Reed | 220/909 X |
| 4,878,592 | 11/1989 | Lee | 220/909 X |
| 4,893,722 | 1/1990 | Jones | 220/503 |
| 4,974,746 | 12/1990 | Dickinson | 220/909 X |
| 4,988,010 | 1/1991 | Pollak | 220/503 |
| 5,005,727 | 4/1991 | Roth | 220/909 X |

*Primary Examiner*—Steven M. Pollard

[57] ABSTRACT

A recycling container is provided with an outer container formed with a flase bottom for supporting four inner containers for respectively receiving three different recyclables and the regular garbage of a family's refuse. The inner containers, which are of different sizes, have shapes complementary to the outer container and each other to make for a compact arrangement. Below the false bottom, the outer container houses a drawer of dimensions adequate to hold the family's newspapers received between pickup collections. Of course, the recycling container is sized so as to hold the different elements of the family's refuse between collections. The largest of the inner containers may be essentially a semi-cylinder to contain the regular garbage. A cover having two portions pivotally interconnected by a life hinge, may be placed on the outer container so that one portion overlies the inner container that is a semi-cylinder and the other portion overlies the other three inner containers. Extensions on the cover faciitate lifting its portions. Embossments having recesses with finger indents and molded on the outer container facilitate handling the recycling container. Openings in the sides of the inner containers facilitate their handling. A recess having finger indents and molded in the face of the drawer facilitates its handling.

13 Claims, 1 Drawing Sheet

RECYCLING CONTAINER

BACKGROUND OF THE INVENTION

1. Field of the Invention

This invention relates to recycling containers, and more particularly to a recycling container of a compact design for handling a plurality of different recyclables.

2. Existing Information

The existing information includes patents to Kostic (U.S. Pat. No. 3,904,218), Crine (U.S. Pat. No. 4,834,253), and Lee (U.S. Pat. No. 4,878,592). Kostic shows a plurality of complementary containers held together on a platform and having a common cover, the cover having openings for the respective containers. Crine shows a number of container configurations in which a plurality of inner containers fit within an outer container, the inner containers having upper handle members for their removal or insertion. Lee shows a plurality of inner containers within an outer container having special gripping means to facilitate removal, and provides space above the inner containers and below their lid to receive a newspaper collection tray.

SUMMARY OF THE INVENTION

An object of the invention is to provide a recycling container of the most compact design feasible for handling one or more recyclables.

Another object of the invention is to provide such a recycling container wherein an inner container is provided for each recyclable and that has a capacity corresponding to the normal proportionate volume of that recycle in a home or business.

Still another object of the invention is to provide a recycling container for a plurality of recyclables that is not much larger than the single garbage containers currently in use, and yet much smaller in space requirements than lining up several independent containers for the respective recyclables.

An additional object of the invention is to provide a compact 5-in-1 recycling container for handling the four common recyclables, namely plastic, glass, metal and paper, and the regular household garbage, or a family's refuse.

Yet another object of the invention is to provide a recycling container that is a convenience in that all of the refuse is in one area contained, separated, and covered.

A further object of the invention is to provide a learning aid enabling children to recognize the recyclables and to show them how the recyclables and the regular garbage can be housed separately in one common container.

A still further object of the invention is to provide a compact recycling container that is simple in construction, in expensive and easy of manufacture, and readily usable.

According to the invention, inner containers having shapes complementary to each other and an outer container in which they are vertically received, rest on a false bottom of the outer container. The larger one of the inner container is essentially semi-cylindrical, and is intended for receiving the regular house garbage that is not recyclable. The three other inner containers, which together make up another semi-cylinder, may be of slightly different sizes and used for respective ones of the plastic, glass, and metal recyclables as best suits each family's experience. Large purchasers of cooked foods may use the largest open of the smaller inner containers for tin cans and other metals; large purchasers of frozen foods may have a lot of plastic refuse.

Between the false bottom and the true bottom of the outer container is a space into which is inserted a drawer from one side of the container. The drawer is of a length and width to accommodate newspapers flatwise and of a height sufficient to accommodate the normal accumulation between refuse collections.

A cover having a life hinge at an intermediate point engages the outer container and closes off the inner containers. The intermediate point is so located that when either portion of the cover is raised about the life hinge, it uncovers fully the inner containers beneath that portion. Suitable detents between downturned rims of the cover portions and the outer surfaces of the outer container, hold the cover in place.

Holes formed in the sides of the upper ends of the inner containers enable finger grasping to handle the inner containers. Finger grasping indents formed in embossed portions on the outer surfaces of the outer container enabling handling of the recycling container. Finger grasping indents formed in a recess in the contoured outer surface of the drawer enables handling of the drawer.

The shapes and arrangements of the recycling container and its components are such that the entire recycling container can be easily and inexpensively molded from suitable plastics.

BRIEF DESCRIPTION OF THE DRAWINGS

These and other objects, features and advantages of the invention will become apparent from a reading of the following description of a preferred embodiment of the invention, when considered with the accompanying drawings wherein.

DETAILED DESCRIPTION OF A PREFERRED EMBODIMENT

Figure 1:
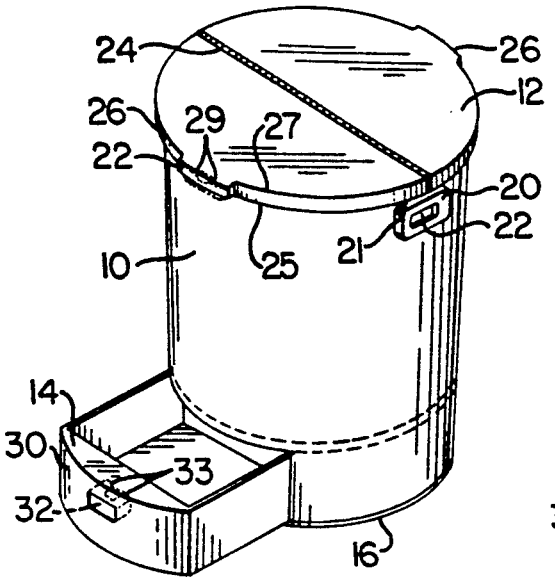
FIG. 1 is a view in perspective of the recycling container, with the drawer pulled open and the cover in place.

Referring now to the drawings, FIG. 1 shows a recycling container having an outer generally cylindrical container 10, a flat cover 12, and a drawer 14 received in the lower portion of the outer container 10 between its bottom 16 and a false bottom 18. At its upper end, the outer container 10 mounts on opposite sides and below the cover 12, embossed portions 20 having recesses 22 formed with finger indents 21 for grasping the container for handling.

The cover 12 is formed with a life hinge 24 at a midpoint. The cover is normally placed on the outer container 10 so that the life hinge 24 extends from one embossed portion 20 to the other. The portions of the cover 12 are molded at their peripheries with downturned rims 26 which embrace the upper end of the outer container 10. The embrace may be a friction fit or by suitable detenting means such as inward protrusions 27 on rims 26 engaging depressions 25 in the container 10. The free ends of the cover portions separated by the life hinge 24 are also molded with extensions 28 of the rims 26 to facilitate lifting of the respective cover portions. The extensions 28 may be formed on their lower sides with finger indents 29.

The drawer 14 is molded essentially in conventional shape, the primary considerations being that it is of a length and width to hold a conventional newspaper and of a height to hold the newspapers normally received by a household between collections. The outer surface of the drawer is of a contour to approximate a continuation of the outer surface of the container 10 when the drawer is in the inserted or closed position. The inner surface of the outer portion of the drawer may be flat since newspapers are generally rectangular, with the result that the outer portion is thicker int he middle and thus has a structurally characteristic making the drawer more rigid and rugged. The thickness also accommodates molding a recess 32 in the drawer face 30, which recess may have upwarding extending indents 33 to facilitate finger grasping to pull out the drawer for loading and unloading operations.

Figure 2:
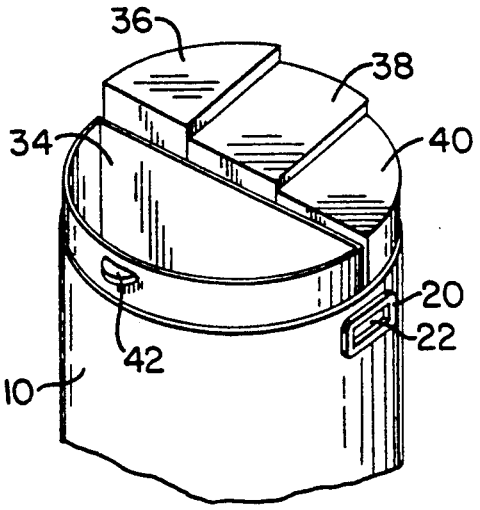
FIG. 2 is a partial view of the container in FIG. 1, with the cover removed and the individual inner containers raised different amounts to show their shapes.

Referring now more particularly to FIG. 2, the outer container 10 is shown as holding four complementary inner containers above its false bottom 18. One inner container 34 is the larger and essentially a semi-cylinder intended to receive the collection period's regular garbage, regular garbage being essentially one-half of normal family's refuse. The other half of the outer container 10 is filled with the three inner containers 36, 38, and 40. The containers 36 and 40 may have shapes approaching that of quarter cylinders but not quite because they are separated by the inner container 38. All have surfaces complementary to the adjacent inner containers and the out container 10. In their installed condition, the inner containers rest on the false bottom 18 of the outer container 10, and would have tops level with each other and the outer container, and not as shown in FIG. 2 for descriptive purposes. The containers would also have a sufficiently loose fit with respect to each other to accommodate the use of liner bags which are overlapped at the top to secure them in place. Removal of the containers is abetted by openings such as the opening 42 in the upper end of the large inner container 34.

It will be appreciated that all of the parts are so shaped that they may be readily molded from suitable plastics.

In use, the drawer 14 would be opened to insert newspapers and closed to store them. The appropriate portion of the cover 12 would be raised via its extension 28 to expose the proper container for the refuse at hand. If regular garbage refuse was at hand, the cover portion overlying the large semi-cylindrical inner container 34 would be lifted to enable deposit therein. Similarly for the other containers, one being used for metal, another for glass, and the third smaller inner container for plastic. Children can observe the different inner containers and the materials being put in them, thus early learning how to reduce pollution and protect the environment.

On collection day, the recycling container would be carried curbside, and left there for the collectors. The collectors on arriving would lift off the cover 12 to gain access to the inner containers, grasping the inner containers via their openings 42 and dumping their contents into appropriate recyclable and garbage bins on the collection truck. Alternatively, liner bags could be removed from the inner containers and placed on the collection truck. They would also remove the drawer 14 to dump the newspapers into the newspaper bin.

Figure 3:
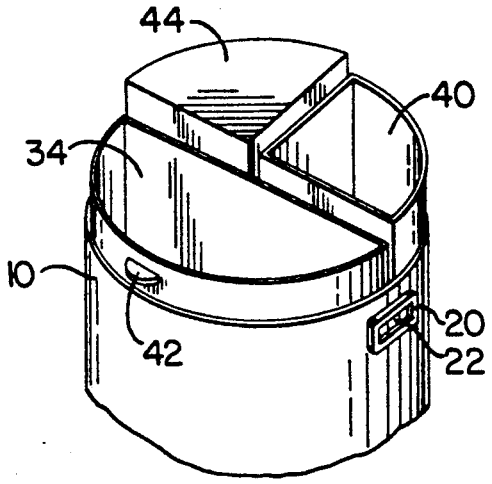
FIG. 3 is a partial view similar to FIG. 2, but with just three inner containers.
Figure 4:
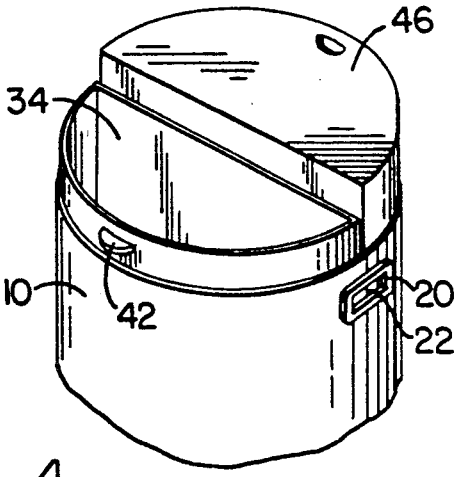
FIG. 4 is another partial view similar to FIG. 2, but with just two inner containers.

Additional embodiments accommodate people who do not have to separate all of the recyclable items. Thus in FIG. 3, besides the inner regular inner garbage container 34, only two inner containers 42 and 44 are employed for recyclables. In FIG. 4, only one inner container 46 is used for a recyclable as in areas wherein only one recyclable is collected or for several recyclables where they are separated after collection.

This it should be apparent that applicant has invented a recycling container of compact design conveniently handling a plurality of recyclables. Further that containers are provided that have a capacity corresponding to the normal proportionate volume of the recyclable in a home or business. Also that the recycling container is not much larger than the single garbage containers currently in use, involving only a simple rearrangement of the refuse. Thus a compact 5-in-1 recycling container has been advised for handling the four common recyclables and the garbage constituting the remainder of the refuse. Additionally it will be apparent that the recycling container is a convenience in that all of the refuse is in one area received, contained, separated, and covered. In the bargain, a learning aid is provided enabling children to recognize recyclables and non-recyclables and to see how they can be housed separately in one common container. It should also be apparent that applicant has provided a compact recycling container that is simple in construction and inexpensive and easy of manufacture, in that it can all be molded of conventional plastic. The recycling container is simple to use by both the family and the collectors.

It will be understood that while applicant has shown a preferred embodiment of the invention, it will be evident to those skilled in the art that other embodiments may be created using principles of the invention. Thus it is intended to be limited only by the scope or spirit of the appended claims.

What is claimed is:

1. A recycling container having an outer cylindrical container with a false bottom, a plurality of inner differently-sized containers having shapes complementary to each other and the outer container, and a drawer housed in the container below the false bottom.

2. A recycling container according to claim 1, and a cover having portions separately raisable.

3. A recycling container according to claim 2, wherein the cover portions are pivoted with respect to each other on a life hinge integral with each portion.

4. A recycling container according to claim 3, and detent means coacting between the cover portions and the outer container to hold the cover portions in place.

5. A recycling container according to claim 3, wherein the cover portions have molded extensions for raising the respective portions.

6. A recycling container according to claim 5, wherein the cover extensions have finger indents on their lower sides.

7. A recycling container according to claim 1, and a cover having portions separately raisable to expose different ones of the inner containers.

8. A recycling container according to claim 7, wherein the cover portions are pivoted with respect to each other on a life hinge.

9. A recycling container according to claim 1, and embossed portions having recesses molded on the outside of the container for handling the container.

10. A recycling container according to claim 9, wherein the recesses in the embossed portions have finger indents.

11. A recycling container according to claim 1, wherein the outer surface of the drawer conforms to the cylindrical shape of the outer container.

12. A recycling container according to claim 11, wherein a recess for handling the drawer is formed in the outer surface of the drawer.

13. A recycling container according to claim 12, wherein the drawer recess is formed with finger indents.

* * * * *